US008782888B2

(12) United States Patent
Saulnier et al.

(10) Patent No.: US 8,782,888 B2
(45) Date of Patent: Jul. 22, 2014

(54) METHOD FOR REPAIRING PLATE HEAT EXCHANGERS

(75) Inventors: Bernard Saulnier, La Garenne Colombes (FR); Jean-Pierre Tranier, L'Hay-les-Roses (FR); François Fuentes, Le Vesinet (FR); Sophie Deschodt, Loos (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 831 days.

(21) Appl. No.: 12/989,674

(22) PCT Filed: Apr. 8, 2009

(86) PCT No.: PCT/FR2009/050608

§ 371 (c)(1), (2), (4) Date: May 19, 2011

(87) PCT Pub. No.: WO2009/136068

PCT Pub. Date: Nov. 12, 2009

(65) Prior Publication Data

US 2011/0258853 A1 Oct. 27, 2011

(30) Foreign Application Priority Data

Apr. 28, 2008 (FR) ..... 08 52845

(51) Int. Cl.
*B23P 6/00* (2006.01)

(52) U.S. Cl.
USPC ..... 29/890.031; 165/166

(58) Field of Classification Search
USPC ..... 29/890.031, 890.03, 890.032; 73/40.5 R, 40; 165/11.1, 11.2, 164, 165
See application file for complete search history.

(56) References Cited

U.S. PATENT DOCUMENTS

| | | | | |
|---|---|---|---|---|
| 3,590,914 | A * | 7/1971 | Duncan | 165/166 |
| 4,090,554 | A * | 5/1978 | Dickinson | 165/11.1 |
| 4,096,885 | A * | 6/1978 | Essebaggers | 138/97 |
| 4,226,113 | A * | 10/1980 | Pelletier et al. | 73/40.7 |
| 4,903,758 | A * | 2/1990 | Cowan | 165/111 |
| 4,942,920 | A * | 7/1990 | Chalifoux et al. | 165/11.1 |
| 5,203,407 | A * | 4/1993 | Nagasaka | 165/174 |
| 5,730,209 | A * | 3/1998 | Sunder et al. | 165/95 |
| 6,341,648 | B1 * | 1/2002 | Fukuoka et al. | 165/144 |
| 6,620,274 | B1 * | 9/2003 | Nagaya et al. | 156/94 |
| 6,923,043 | B2 * | 8/2005 | Rabelle | 73/40.5 R |
| 2008/0047687 | A1 * | 2/2008 | Leitch et al. | 165/70 |
| 2010/0263823 | A1 * | 10/2010 | Mitsuhashi et al. | 165/11.1 |
| 2011/0258853 | A1 * | 10/2011 | Saulnier et al. | 29/890.031 |

FOREIGN PATENT DOCUMENTS

| | | |
|---|---|---|
| FR | 1472493 | 3/1967 |
| GB | 1125175 | 8/1968 |

OTHER PUBLICATIONS

Written Opinion for PCT/FR2009/050608, Dated Dec. 18, 2010.
Search Report for PCT/FR2009/050608, Dated Oct. 15, 2009.

* cited by examiner

*Primary Examiner* — Jacob Cigna
(74) *Attorney, Agent, or Firm* — Justin K. Murray

(57) ABSTRACT

A method for repairing a plate heat exchanger of the type comprising a plurality of plates which, together with side bars arranged on the plates, define fluid flow paths is presented.

7 Claims, No Drawings

METHOD FOR REPAIRING PLATE HEAT EXCHANGERS

This application is a §371 of International PCT Application PCT/FR2009/050608, filed Apr. 8, 2009.

FIELD OF THE INVENTION

The present invention relates to a method for repairing a plate heat exchanger of the type comprising a plurality of plates which, together with side bars arranged on the plates, define fluid flow paths.

BACKGROUND

Plate heat exchangers usually consist of a stack of plates defining passages for fluids.

In order to improve the heat exchange between the fluids, corrugated sheets known as fins can be "sandwiched" between said plates forming the heat exchanger. The resulting passages are closed on either side by side bars. Once assembled, the heat exchanger is brazed to give the assembly mechanical strength and improved thermal contact.

Prior art heat exchangers are capable of exchanging heat between many fluids. It is common to find plate heat exchangers handling more than five fluids.

However, being highly compact, plate heat exchangers are also used in processes using only two fluids. Typically, this type of exchanger corresponds to an evaporator-condenser. In this configuration one fluid is evaporated by extracting heat from a second fluid which condenses.

If the brazing of the side bars of the evaporation passages is of poor quality, a leak can develop between a condensation passage and an evaporation passage. This reduces the purity of the fluid to be evaporated. In some processes this purity is critical, and such a leak can necessitate repairing or changing the plate heat exchanger.

One option would be to repair a heat exchanger by sealing off the leaky evaporation passage by closing it at the inlet and outlet and leaving this leaky passage in contact with the condensation passage, to which it is directly adjacent. The pressures between the two passages would thus equalize.

Traditionally, the condensation passages operate at pressures above those of the evaporation passages. Plate heat exchangers must therefore be designed so that the evaporation and condensation passages can withstand an identical pressure. Such a plate heat exchanger design increases the cost without any concomitant improvement in the thermal performance of said exchanger.

It is an object of the present invention to provide a method for repairing a plate heat exchanger that does not require a particular design of said exchanger.

SUMMARY OF THE INVENTION

The invention thus provides a method for repairing a plate heat exchanger of the type comprising a plurality of plates which, together with side bars arranged on the plates, define fluid flow paths, one of which paths has a leak to an adjacent path, the method comprising at least the following successive steps:

- the two adjacent paths are isolated, and
- one and the same fluid is injected at a pressure of between 0.5 bar and 1.5 bar into the two adjacent paths.

DETAILED DESCRIPTION OF THE INVENTION

For a further understanding of the nature and objects for the present invention, reference should be made to the detailed description, taken in conjunction with the accompanying drawing, in which like elements are given the same or analogous reference numbers and wherein:

Advantageously, a repair method according to the invention can be used to repair a plate heat exchanger regardless of the geometry of the latter. In particular, the invention will be especially advantageous in repairing heat exchangers comprising finless passages. The reason is that a method according to the invention involves placing the two adjacent paths at the same pressure as each other, generally between 0.5 and 1.5 bar, creating slight mechanical stresses between the two adjacent paths.

A method according to the invention can also include one or more of the following optional features, taken individually or in any possible combination:

- after having isolated the two adjacent paths, a header is arranged on the side bars of the two adjacent paths, thus allowing one and the same fluid to be injected into said adjacent paths;
- the fluid injected into the two adjacent paths is an inert gas;
- the fluid injected into the two adjacent paths is nitrogen gas.

The invention consists in isolating two adjacent paths of a heat exchanger and equalizing the pressure between these two adjacent paths in such a way as to reduce the mechanical stresses between these two paths.

Advantageously, the equilibrium pressure between the two paths is selected to be between 0.5 and 1.5 bar so as further to reduce the mechanical stresses inside the heat exchanger.

The two adjacent paths can be isolated by plates welded to the inlet and outlet of these two paths, or by any other means known to those skilled in the art.

The header which can be mounted on the side bars of the two adjacent paths in order to inject the fluid into the two paths, can take the form of a half-cylindrical volume provided with a fluid inlet means.

Advantageously, the header can be mounted so as to straddle the two adjacent paths.

The injected fluid may be a chemically inert gas.

Advantageously, the injection of a chemically inert gas ensures that this gas does not react with the other fluids flowing through said heat exchanger.

The inert gas is preferably selected to have a condensation temperature below the operating temperature of the heat exchanger.

For example, if the heat exchanger is used as an evaporator-condenser for an Air Separation Unit (ASU), nitrogen gas can be used as the inert fluid because the condensation temperature of nitrogen is below the operating temperature of the heat exchanger in an Air Separation Unit.

The invention is not limited to the embodiment described and should be interpreted non-restrictively as encompassing all equivalent embodiments. In particular, the method according to the invention is applicable to any type of plate heat exchanger, regardless of its application and dimensions, the evaporator-condensers of Air Separation Units being only a prominent example of its application.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for repairing a plate heat exchanger of the type comprising a plurality of plates which, together with side bars arranged on the plates, define fluid flow paths, one of which paths has a leak to an adjacent path, the method comprising at least the following successive steps:

isolating the two adjacent paths; and injecting an injection fluid at a pressure of between 0.5 bar and 1.5 bar into the two adjacent paths, wherein the two adjacent paths are isolated from the remainder of the heat exchanger such that the injection fluid is within only the two adjacent paths during operation.

2. The method of claim 1, wherein after having isolated the two adjacent paths, a header is arranged on the side bars of the two adjacent paths, thus allowing the injection fluid to be injected into said adjacent paths.

3. The method of claim 1, wherein the injection fluid injected into the two adjacent paths is an inert gas.

4. The method of claim 1, wherein the injection fluid injected into the two adjacent paths is nitrogen gas.

5. The method of claim 1, wherein the heat exchanger is an evaporator-condenser of an air separation unit.

6. The method of claim 1, wherein the injection fluid does not condense within the two adjacent paths during operation.

7. The method of claim 1, wherein the injection fluid does not react with other fluids flowing through the heat exchanger during operation.

* * * * *